US006568950B2

(12) United States Patent
Rudoy et al.

(10) Patent No.: US 6,568,950 B2
(45) Date of Patent: May 27, 2003

(54) UMBILICAL DISCONNECT CONNECTOR

(76) Inventors: Edward Rudoy, 4625 Wolfe Way, Woodland Hills, CA (US) 91364; Larry Leroy McCormick, 21603 Devonshire St., No. 103, Chatsworth, CA (US) 91311; Edwin E. Vega, 5261 Calatrana Dr., Woodland Hills, CA (US) 91364; Craig W. Courtney, 7631 Wiscasset Dr., West Hills, CA (US) 91304

( * ) Notice: Subject to any disclaimer, the term of this patent is extended or adjusted under 35 U.S.C. 154(b) by 0 days.

(21) Appl. No.: 09/838,706

(22) Filed: Apr. 19, 2001

(65) Prior Publication Data

US 2002/0004330 A1 Jan. 10, 2002

Related U.S. Application Data

(60) Provisional application No. 60/199,000, filed on Apr. 19, 2000.

(51) Int. Cl.[7] ..... H01R 13/627
(52) U.S. Cl. ..... 439/352; 439/923
(58) Field of Search ..... 439/350, 352, 439/357, 180, 923

(56) References Cited

U.S. PATENT DOCUMENTS

| | | | | | |
|---|---|---|---|---|---|
| 3,368,182 | A | * | 2/1968 | Culver | 439/352 |
| 3,953,098 | A | * | 4/1976 | Avery et al. | 439/258 |
| 4,017,139 | A | * | 4/1977 | Nelson | 439/352 |
| 5,746,619 | A | * | 5/1998 | Harting et al. | 439/352 |
| 5,807,129 | A | * | 9/1998 | Konda et al. | 439/348 |
| 6,056,577 | A | * | 5/2000 | Blanchet | 439/352 |
| 6,093,043 | A | * | 7/2000 | Gray et al. | 439/352 |

* cited by examiner

*Primary Examiner*—Tulsidas Patel

(74) *Attorney, Agent, or Firm*—Lewis B. Sternfels

(57) ABSTRACT

A receptacle assembly (34) includes a radial groove (58) supported by a housing (46) which houses a plurality of electrical sockets (50). A radial abutment (60) is positioned on the housing adjacent the radial groove. A plug assembly (32) includes cantilever fingers (88) terminating in radially inwardly and outwardly directed protuberances (90,92). The inwardly directed protuberances are disposed to engage the radial groove. A locking sleeve (78) has a radially inward directed annular groove (112) and a surface (110) adjacent to groove (112). The sleeve groove is alignable with outwardly directed protuberances (92) to permit radial deflection of the cantilevered fingers and movement of inwardly directed protuberances (90) over the abutment and into groove (58). The sleeve is movable to position its surface (110) over outwardly directed protuberances (92) to lock inwardly directed protuberances (90) in groove (58). A shell (76) is engageable with the cantilevered fingers and the locking sleeve, and is moveable by a coupling ring (64) to effect the respective engagement relationships of the protuberances in their respective grooves. A restraining shaft (114) is connected to the locking sleeve and to a manifold assembly (116) to lock proturbances (90) in groove (58) and to permit movement of the locking sleeve under spring action away from its retention of protuberances (90) in groove (58). Operation is assisted by use of an ejection spring (62), a loading spring (146) and a plurality of withdrawl springs (144). Engagement between collet detent (168) and a notch (72) in a timing ring (68) secured to the coupling ring provides precise movement of the shell without depending upon the accuracy of the threaded engagement between the shell and the coupling ring.

10 Claims, 15 Drawing Sheets

40
52
32
64
68
70
80
74
66
100
158
76
150
78
30
112
63
62
61
34
46
44
148
144
154
94
160
96
38
42
60
58
152
146
158
104
150
106
108
62

Fig. 20.
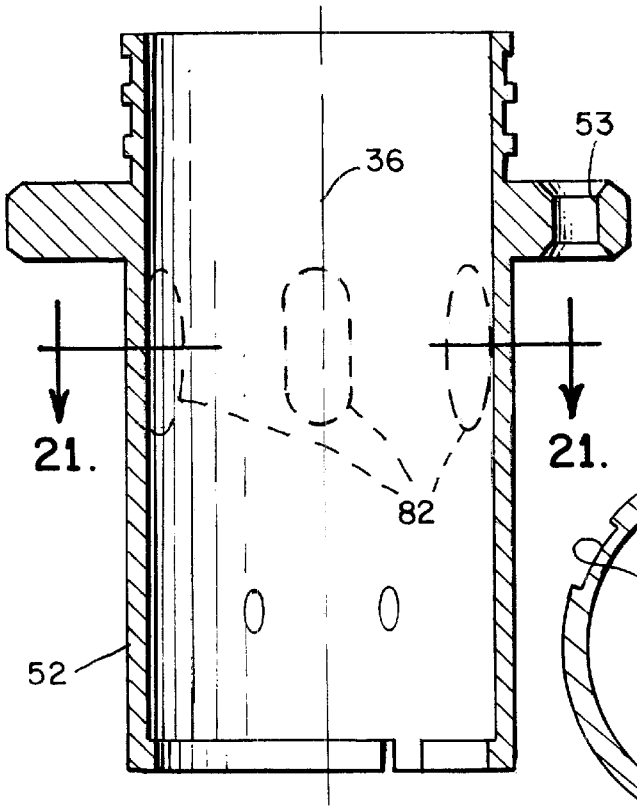
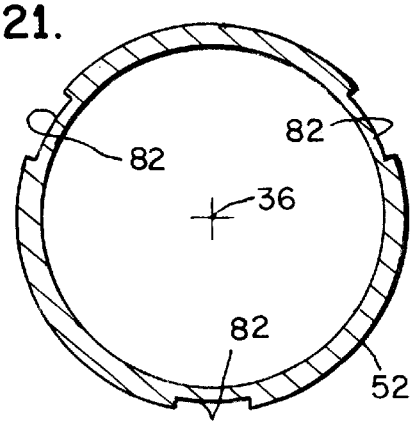
Fig. 21.
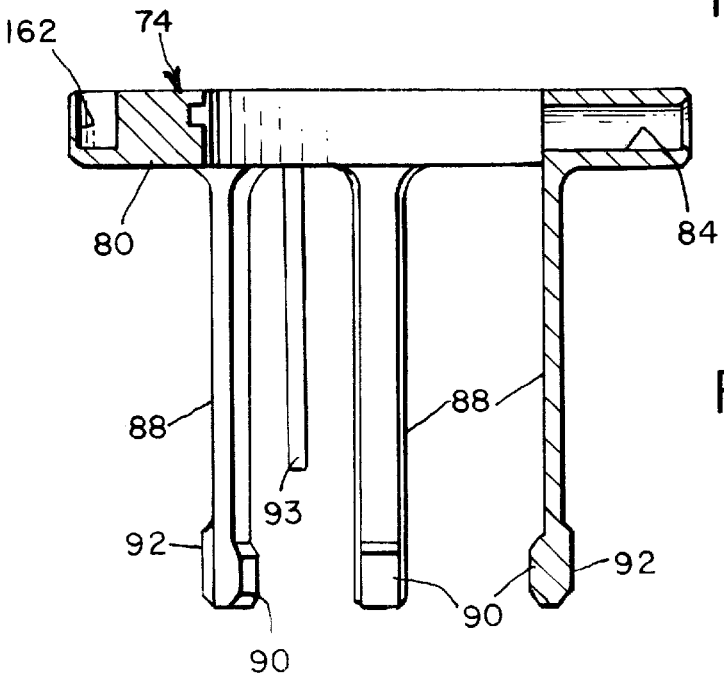
Fig. 19.

UMBILICAL DISCONNECT CONNECTOR

CROSS-REFERENCE TO RELATED APPLICATION

This application claims the benefit of U.S. Provisional Application No. 60/199,000, filed Apr. 19, 2000.

REFERENCE REGARDING FEDERAL SPONSORSHIP

Not Applicable

REFERENCE TO MICROFICHE APPENDIX

Not Applicable

TECHNICAL FIELD OF THE INVENTION

The present invention relates to connectors of electromagnetic energy carriers and, more particularly, to facile repeated mating and unmating thereof without harm or stress to associated structures or the connector itself or, at least, to limit the harm.

BACKGROUND OF THE INVENTION

In any application where the electrical, fiber optic, pneumatic or other connection is necessary until separation, the connection must be quickly and easily severed. Such applications include launches of satellites from mother vehicles, stage separation within a single rocket, and the like. The departing vehicle on such as a satellite typically operated on low power. Anything that would create a distorting force would throw it off its trajectory.

In addition, it is often necessary to provide an electrical data and/or power connection between two structures that can be easily and quickly separated from each other at the proper time, e.g., upon the launch of a satellite or stage separation of a launch vehicle. This typically takes the form of a two-part connection assembly comprising a unit having pins and a unit having a like number of sockets. By way of an example, a satellite may require a 41-pin connection between stages of a launch vehicle (or to an adjoining satellite in a "stacked" configuration) until the moment of release. Such a connector must mate easily, stay in place and then release easily. It is important or, at least, very helpful if such connectors can be repeatedly mated and unmated without damage or harm to associated structures. If the triggering mechanism for separating such connectors is initiated by an explosive charge, such as by a squib, an added attraction is to limit any damage to the area of the charge, in order to protect the remaining connector from any deleterious effects of the explosion.

Furthermore, where threaded interconnections are used in the connectors, reliance in timing between parts may utilize timing of the threads in the interconnections. This requires precision in forming the threads, which adds expense to the connectors.

SUMMARY OF THE INVENTION

An umbilical connector includes separable halves, a plug assembly and a receptacle assembly. When mated, the connector provides electrical continuity for a plurality of isolated electrical or other electromagnetic energy circuits throughout a predetermined range of flight and storage environments. The connector is manually matable and is dematable by manual or automatic triggering means. Manual mating and demating is accomplished by rotating an internally threaded cylindrical coupling ring located on the exterior of one of the assemblies with respect to an element coupled to a collet having peripheral locking fingers. While in the mated condition, the connector assemblies are maintained locked together by the peripheral locking fingers having protuberances on one assembly which are engageable with grooves on the other assembly by a locking sleeve on the other assembly. Remote separation may be accomplished by such means as a squib, for example, for pyrotechnically ignition.

In contradistinction to the above described timing of threads, the present invention allows adjustment by using a timing ring attached to the coupling ring, a notch on the timing ring to provide a reference point, and a detent on the collet. The adjustment is set by properly orienting the timing ring with respect to the coupling ring. This arrangement compensates for the need to establish a polar timing of the threaded engagement between the coupling ring and the element coupled to the collet, that is, the positioning of plug assembly housing with reference to the collet, when the detent is in the notch.

Several advantages are derived from this arrangement. Separation is rapidly effected without shock or harm to any structures associated with the connector. Mating and demating is easily effected and repeatable without damage to or degradation of the connector parts, and without needing to refurbishment or resetting after each mating-unmating cycle. If triggering of the separation is initiated by an explosive charge, any damage is limited to the manifold assembly, which can be easily replaced without other affect to the plug and receptacle assemblies. Mating between the assemblies can be effected using a single hand. A "soft docking" is provided in which little force is required to mate the assemblies. The provision of an explosively triggered disconnect between the assemblies milliseconds before separation avoids the problems associated with anything that would create a distorting force that would throw the departing vehicle off its trajectory. Adjustment of the coupling ring by timing the threads is avoided by use of a timing ring.

Other aims and advantages, as well as a more complete understanding of the present invention, will appear from the following explanation of an exemplary embodiment and the accompanying drawings thereof.

BRIEF DESCRIPTION OF THE DRAWINGS

To assist in the understanding of the present invention as described below in the following figures thereof, the umbilical disconnect connector is better understood by illustrating it with the aid of three sections taken through its constituent plug and receptacle assemblies. Because the receptacle assembly is uniformly constructed, the distinction with respect to the sections pertains to the plug assembly. In general, for ease of explanation, the following representations of the present invention depict it in three of its states, viz., its ready-to-mate, its mated and its triggered states. The latter state, the triggered state, can occur under any circumstance where the receptacle and plug assemblies are separated from one another, such as by mechanical, pneumatic, electromechanical, ordnance, hydraulic and manual means.

FIGS. 15–18 are views of the plug assembly shell, in which

FIG. 15 is a side elevation view thereof,

FIG. 16 is a view taken along line 16—16 of FIG. 15,

FIG. 17 is a view taken along line 17—17 of FIG. 15 and

FIG. 18 is a view taken along line 18—18 of FIG. 16;

FIG. 19 is a cross-sectional side view of the collet;

FIG. 20 is a cross-sectional side view of the housing;

FIG. 21 is a view of the housing taken along line 21—21 of FIG. 20.

DETAILED DESCRIPTION OF THE PREFERRED EMBODIMENTS

Figure 4:
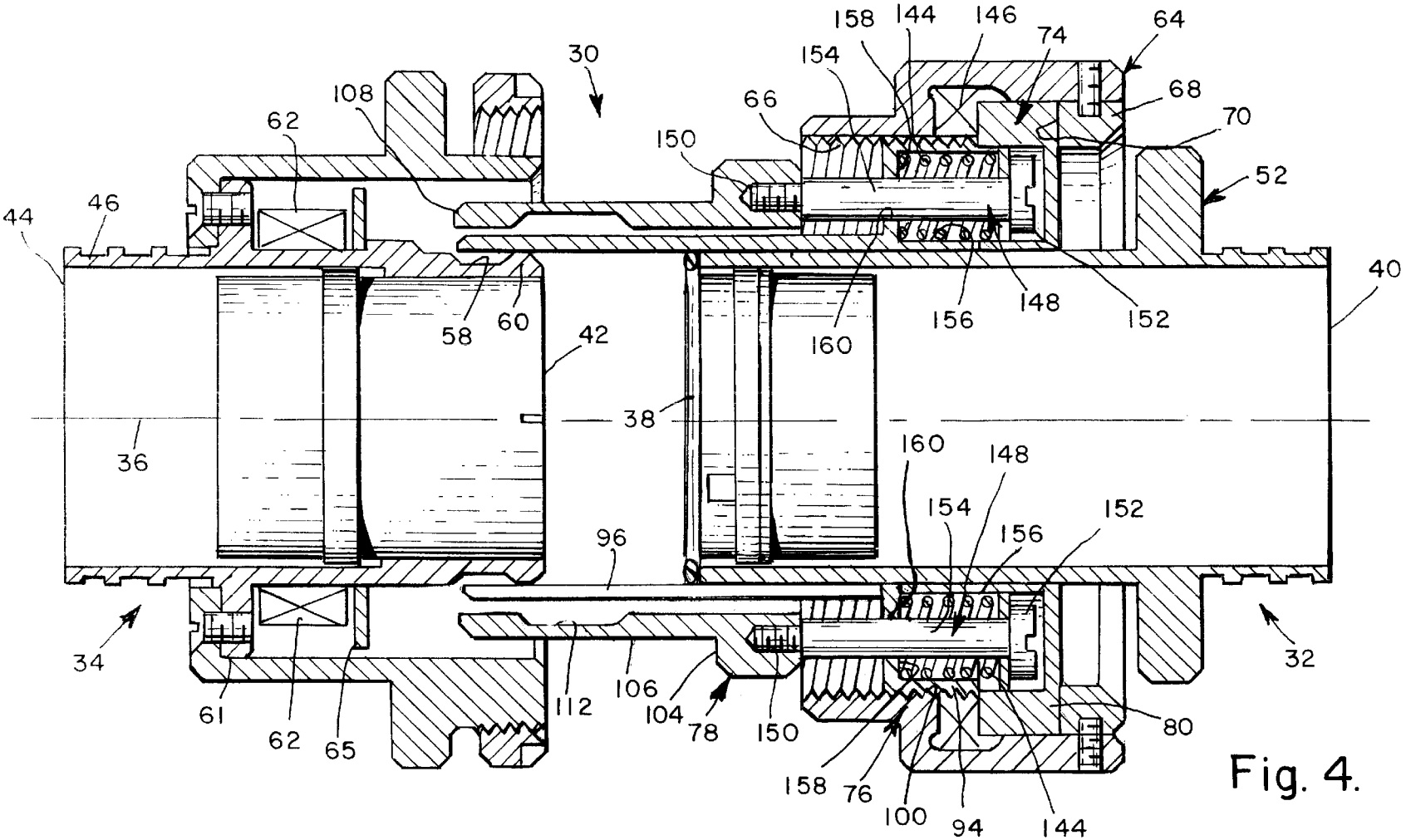
FIGS. 4–6 are elevational views in cross-section of the present invention depicting the umbilical disconnect connector respectively in its ready-to-mate, mated and its triggered states, in which the cross-section is taken through two of the six withdrawal pins and springs in the plug assembly.
Figure 5:
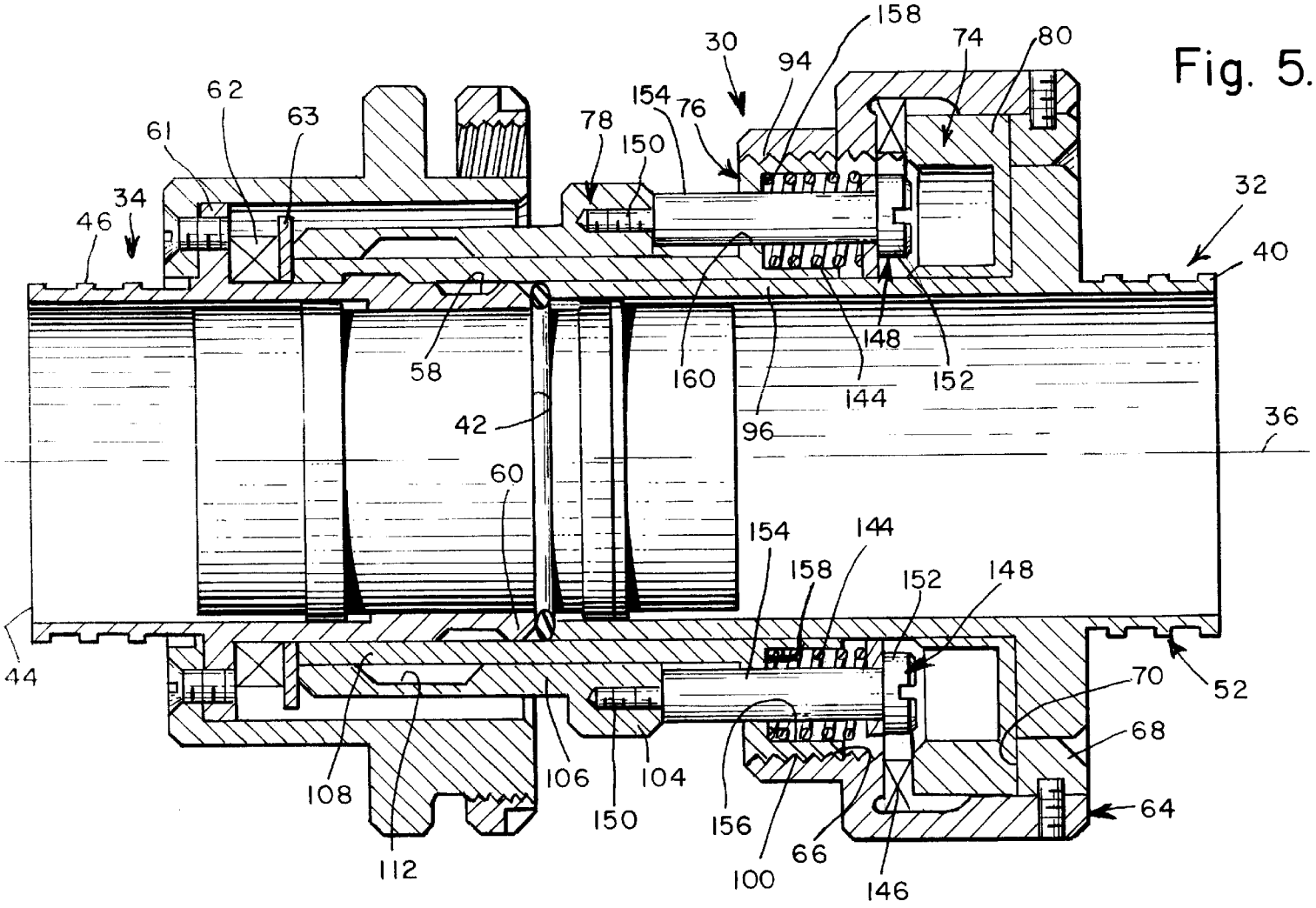
Figure 6:
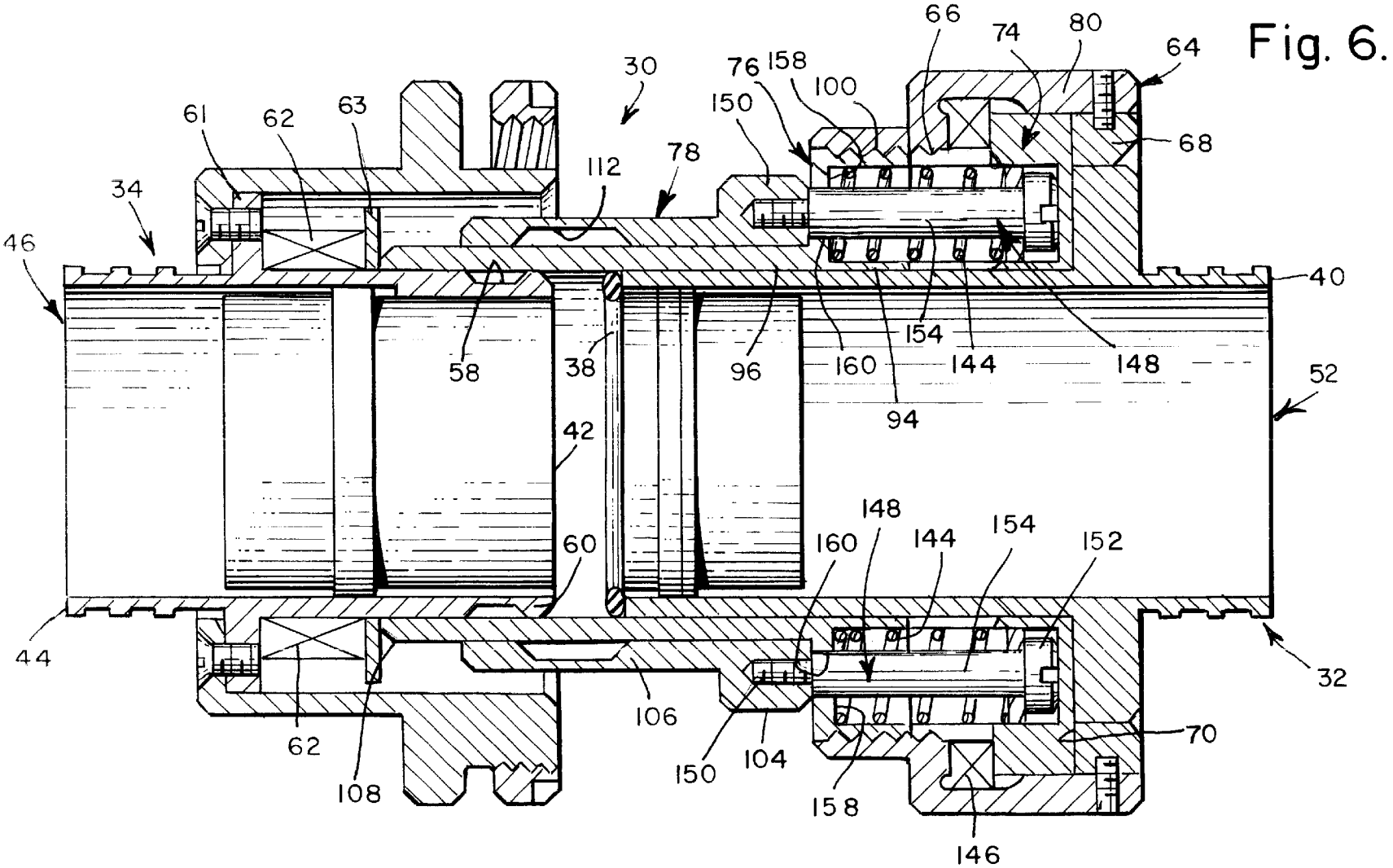
Figure 7:
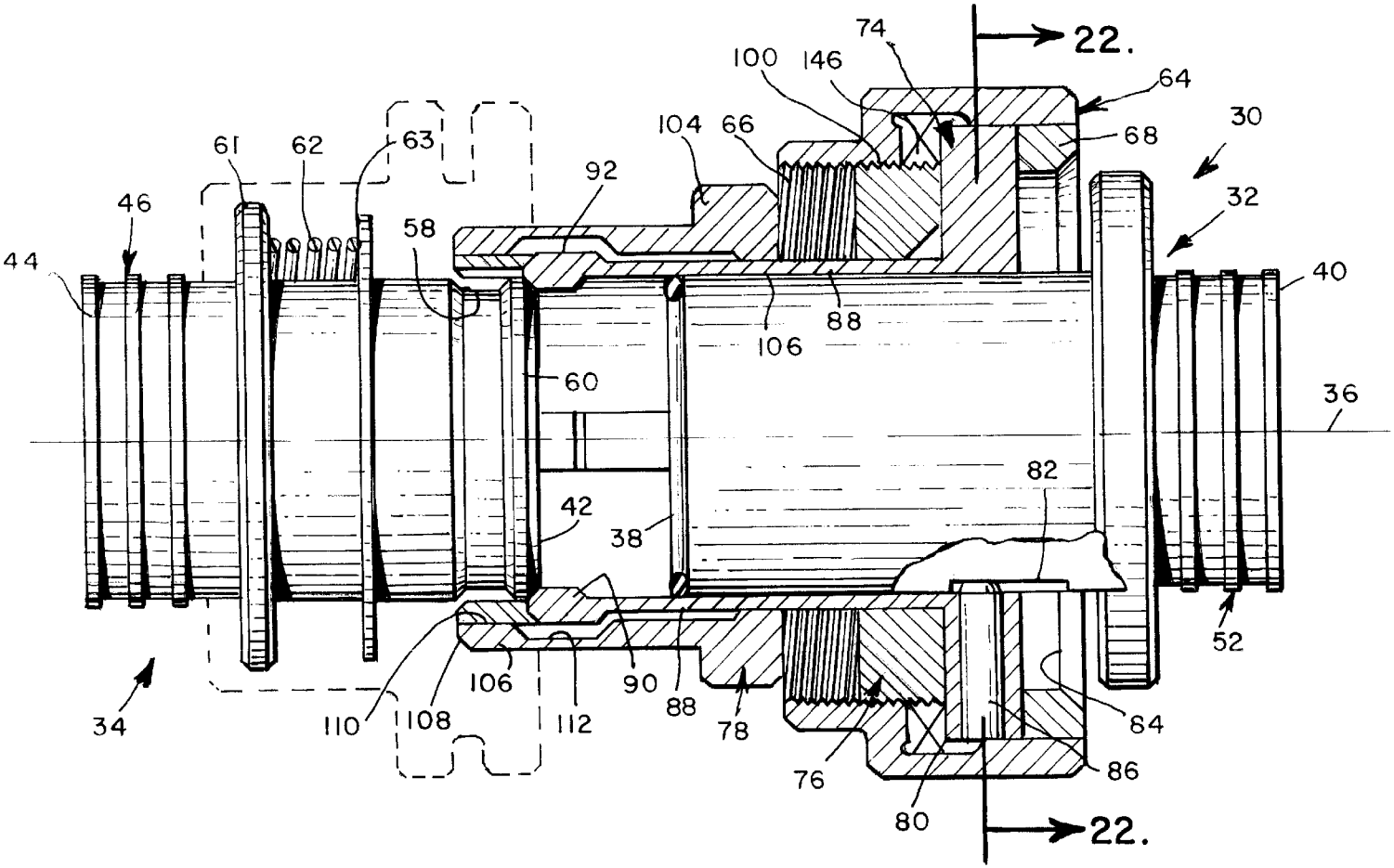
FIGS. 7–9 are elevational views in cross-section of the present invention depicting the umbilical disconnect connector respectively in its ready-to-mate, mated and its triggered states, in which the cross-section is taken through two of the six shell slots and collet fingers residing therein of the plug assembly.
Figure 8:
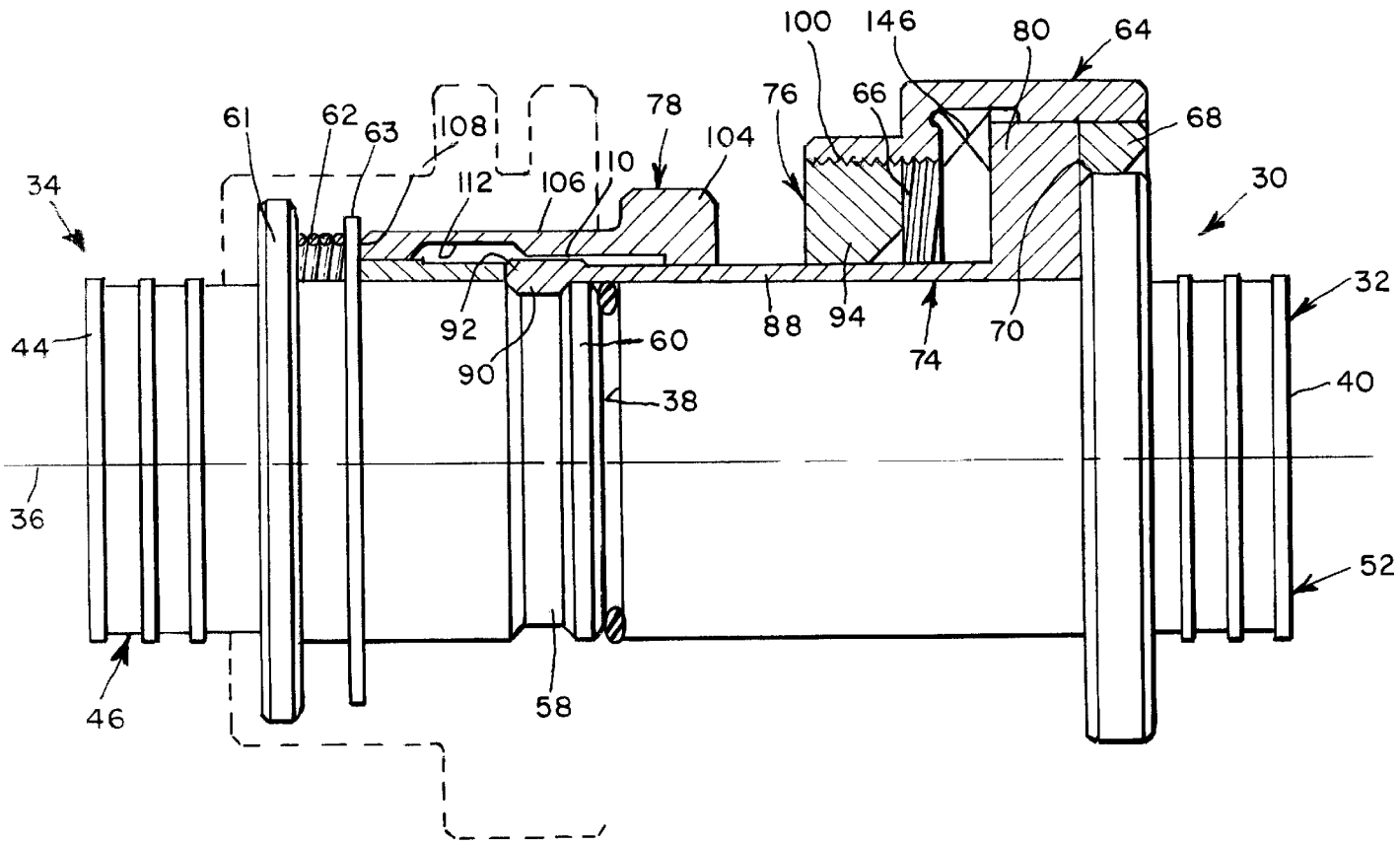
Figure 9:
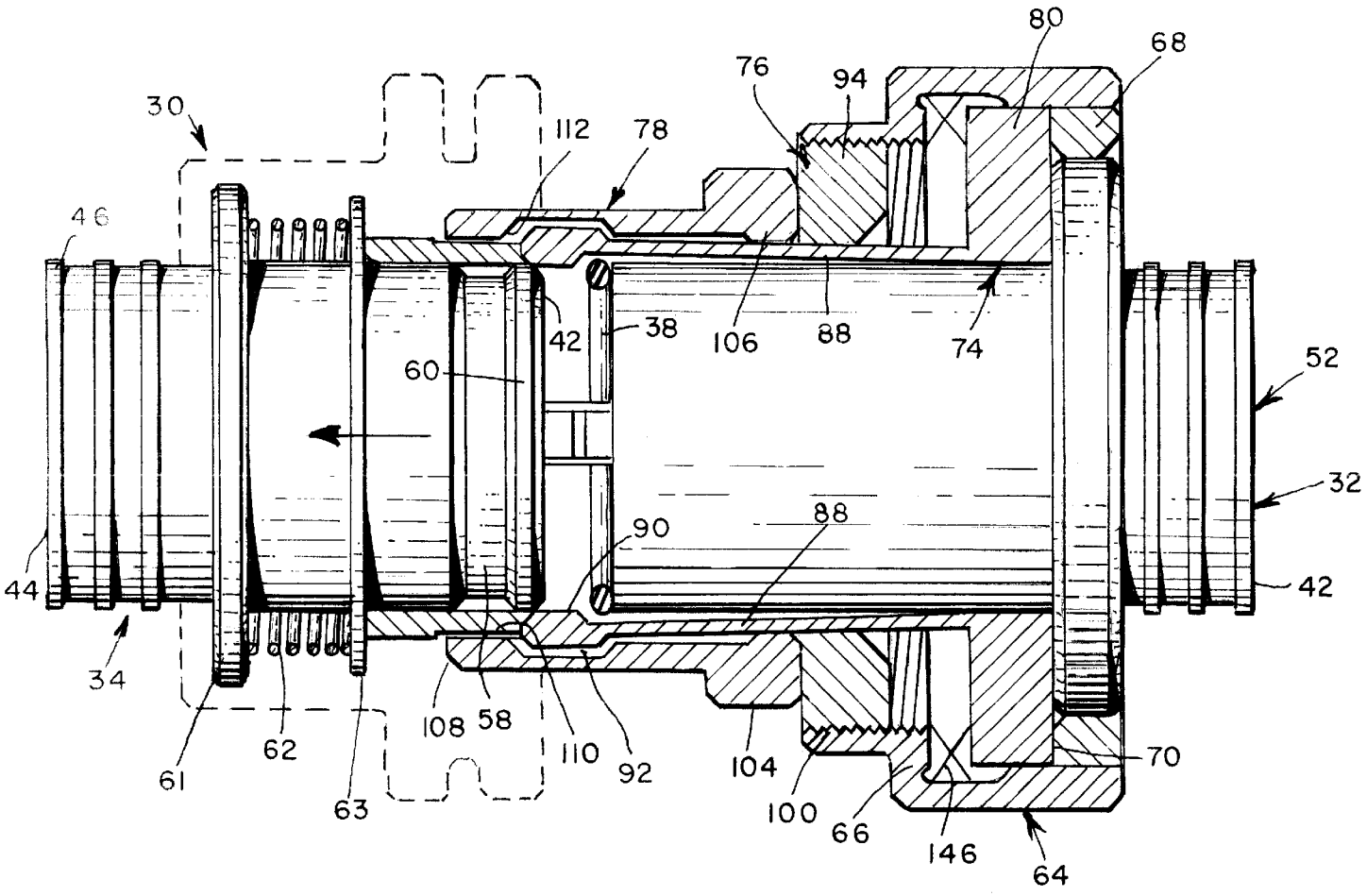
Figure 22:
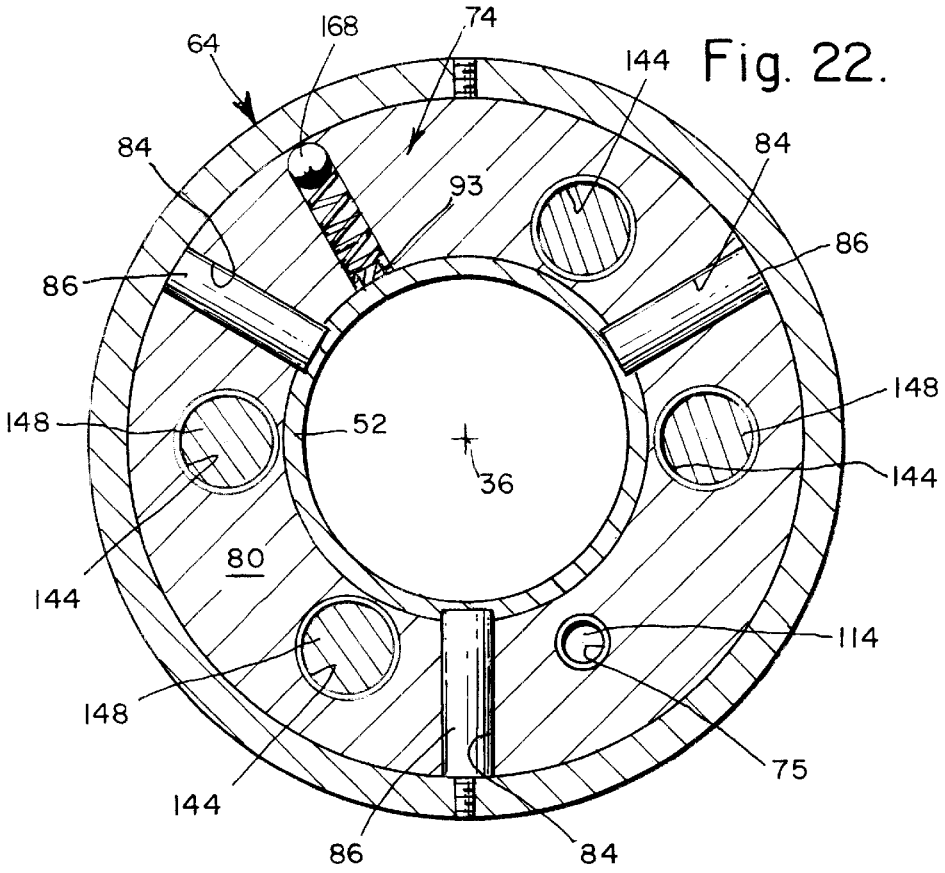
FIG. 22 is a cross-sectional view of the plug assembly taken along line 22—22 of FIG. 7.

With reference to the several figures, an umbilical disconnect connector 30 comprises a plug assembly 32 and a receptacle assembly 34. Both plug and receptacle assemblies are shown as being deployable in ready-to-mate (FIGS. 1, 4 and 7), mated (FIGS. 2, 5 and 8) and triggered states (FIGS. 3, 6 and 9), and lie on a common center axis 36. Plug assembly 32 is bounded by front and rear ends 38 and 40, and receptacle assembly 34 front and rear ends 42 and 44. Front ends 38 and 42 are disposed to face one another.

Receptacle assembly 34 includes a housing 46 which is disposed to receive and support electric wires 48 or other electromagnetic energy carrier means, e.g., optical fibers, and is terminated by sockets 50, or other termination means. In like manner, plug assembly includes a housing 52 which is disposed to receive and support electric wires 54 or other electromagnetic energy carrier means, and is terminated by a contact pins 56, or other termination means. The electrical wires, contact pins and sockets are of conventional construction, and are held within conventional supporting structure. When the plug and receptacle assemblies are coupled together, the respective pins and sockets mate. Both assemblies also are appropriately keyed together in any known manner to provide a proper mating orientation and electrical connection of the respective pins and sockets.

It is to be understood that, while the plug assembly has been described as housing pin contacts and the receptacle assembly has been described as housing sockets, the housing arrangements may be reverse-gendered, i.e., sockets may be housed within the plug assembly and pin contacts may be housed in the receptacle assembly.

Receptacle housing 46, adjacent front end 42, ends in an annular groove 58 facing outwardly from axis 36, and is positioned adjacent to sockets 50. An abutment 60, positioned adjacent to annular groove 58, provides the terminus to receptacle front end 42. An ejection spring 62, which is centered about the axis, is positioned between the annular groove and the receptacle assembly rear end, specifically between a flange 61 formed on housing 46 and a washer 63 moveable along axis 36. Depending upon the ready-to-mate, mated and triggered state of umbilical disconnect connector 30, the ejection spring has conditions of being relatively uncompressed and fully compressed.

Plug assembly 32 includes a coupling ring 64, having internal threads 66 facing the axis, and a timing ring 68, having a surface 70 extending normal to the axis. A notch 72 is formed in surface 70, the use of which will be explained shortly.

Plug assembly housing further includes and supports a collet 74, a shell 76 and a locking sleeve 78 positioned about axis 36.

Collet 74 includes a hub 80 concentrically surrounding plug assembly housing 52 and having a connection therewith for enabling an axial translation and a non-rotatable coupling therebetween. This connection, as best illustrated in FIGS. 7, 20, 21 and 22, comprises three generally oval-shaped slots 82 in housing 52, three radially extending cylindrical holes 84 in collet 74, and three dowel pins 86 secured within holes 84 and extending into oval slots 82. Accordingly, collet 74 can move in a limited manner, as restricted by the length of oval slots 82, in translation with respect to housing 52 along the axis, but is prevented from rotating about the housing.

As best shown in FIGS. 7–9, 19, the collet is formed with a plurality of cantilevered fingers 88 extending from hub 80. Fingers 88 lie substantially parallel to axis 36 and extend towards receptacle assembly housing 46, and individually terminate in a pair of protuberances 90 and 92 which extend respectively towards and away from the axis. Cantilevered fingers 88 are capable of bending with a biased movement towards and away from the axis. A longitudinally extending limiting bar 93 or keyway limiter (see FIGS. 1–3, 12,13,19 and 22) extends parallel to fingers 88 but is shorter in length than the fingers.

As best illustrated in FIGS. 1–3 and 16–18, shell 76 comprises a support 94 and a cylindrical portion 96. A plurality of slots 98 are formed in the cylindrical portion. Portion 96 and its slots 98 extend from support 94 in parallel with the axis towards receptacle assembly housing 46, and are sized for respective receipt therein of collet cantilevered fingers 88. The support is provided with external threads 100 which are threadedly engaged with coupling ring threads 66. A keyway limiter slot 102 (see also FIGS. 1–3, 12–14, 16–18, and 22) extends parallel to finger slots 98, and is disposed to receive limiting bar 93 therein. The purpose of bar 93 is to contact terminal abutment 60 and thereby limit the extent of the insertion of plug assembly 32 into receptacle assembly 34.

Locking sleeve 78 (see FIGS. 1–9, 14) comprises a rim 104 and a cylindrical portion 106 which is secured to the rim and which extends parallel to the axis towards receptacle assembly housing 46. An end 108 terminates the cylindrical portion. An interior surface 110 of cylindrical portion 106 is generally in contact with collet fingers 88 (see FIGS. 7–9) and shell cylindrical portion 96 (see FIGS. 1–6). An annular groove 112 is formed in cylindrical portion 106 adjacent its end and faces inwardly towards axis 36.

A restraining shaft or rod 114 is threaded to rim 104 by means of a screw and nut coupling 115 to secure the restraining shaft to locking sleeve 78. Openings 53 in housing 52, 75 in collet hub 80, and 95 in shell support 94 permit passage and reciprocation of shaft 114 therein. The shaft is positionable parallel to axis 36 for enabling the locking sleeve to be placed in locking and unlocking positions with regard to the positioning, and locking and unlocking of protuberances 90 and 92 with annular grooves 58 and 112. The locking and unlocking positions of restraining shaft 114 is controlled by a manifold assembly 116.

Figure 1:
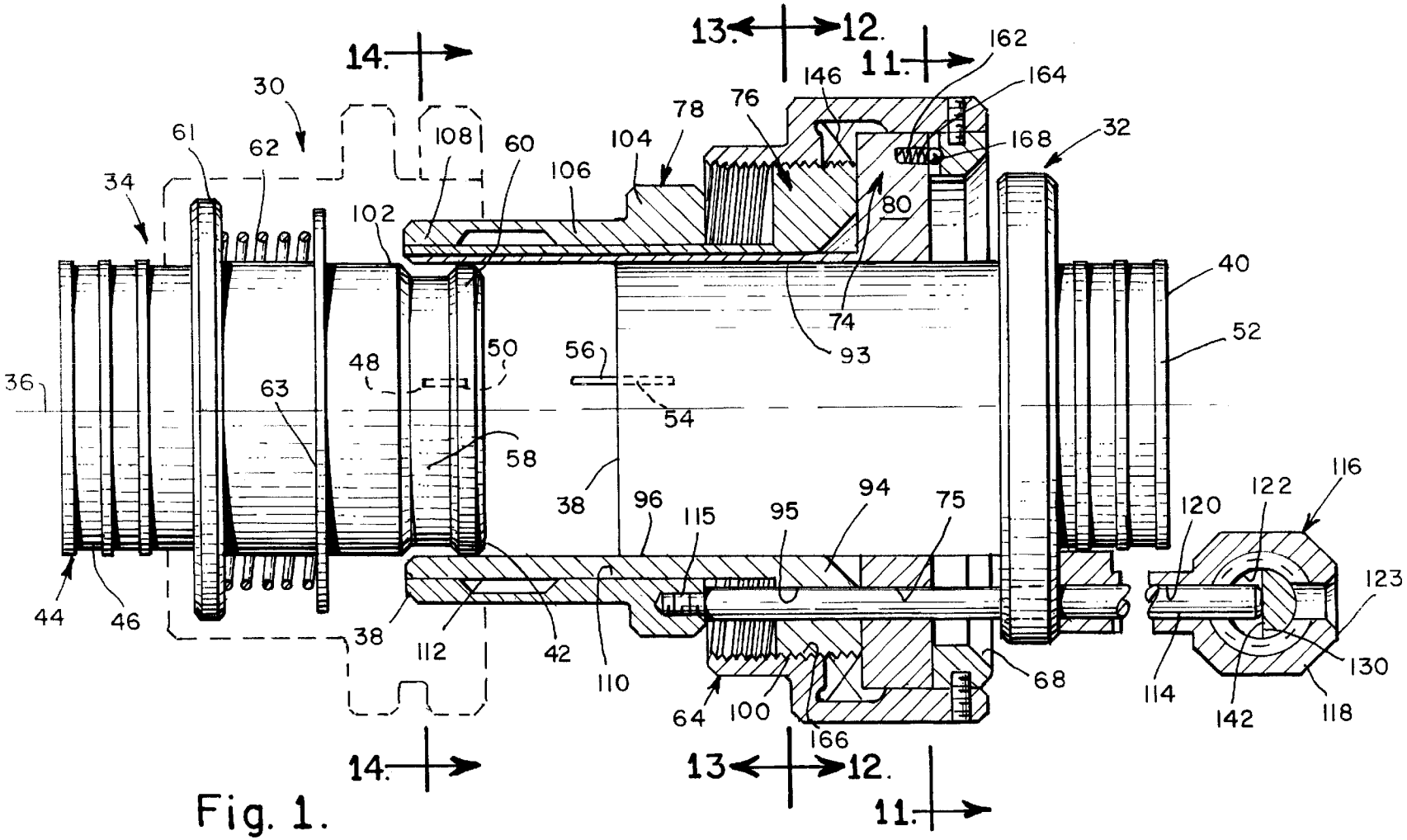
FIGS. 1–3 are elevational views in cross-section of the present invention depicting the umbilical disconnect connector respectively in its ready-to-mate, mated and its triggered states, in which the cross-section is taken through the locking finger and manifold assembly of the plug assembly for locking and remote release of the receptacle assembly from the plug assembly.
Figure 2:
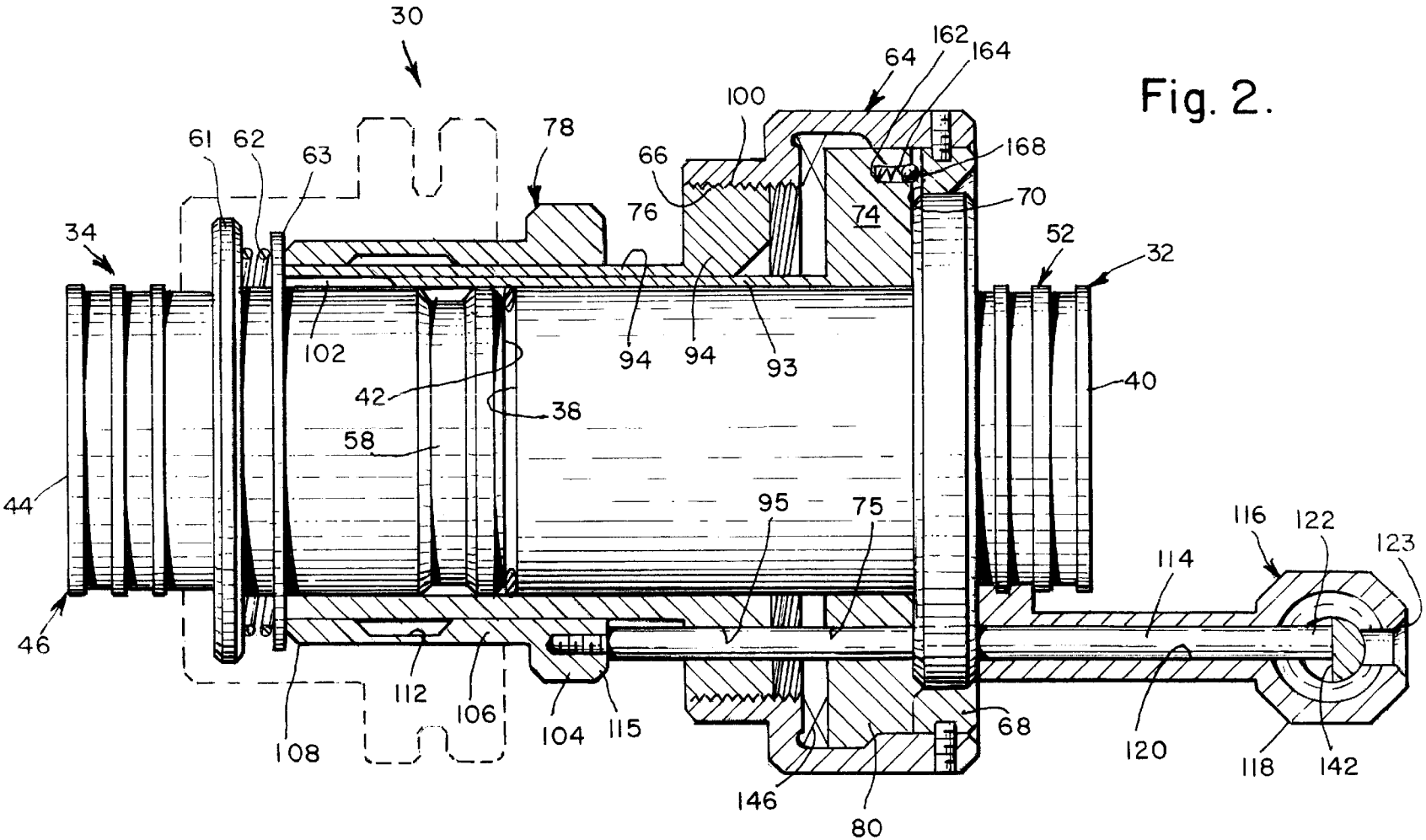
Figure 3:
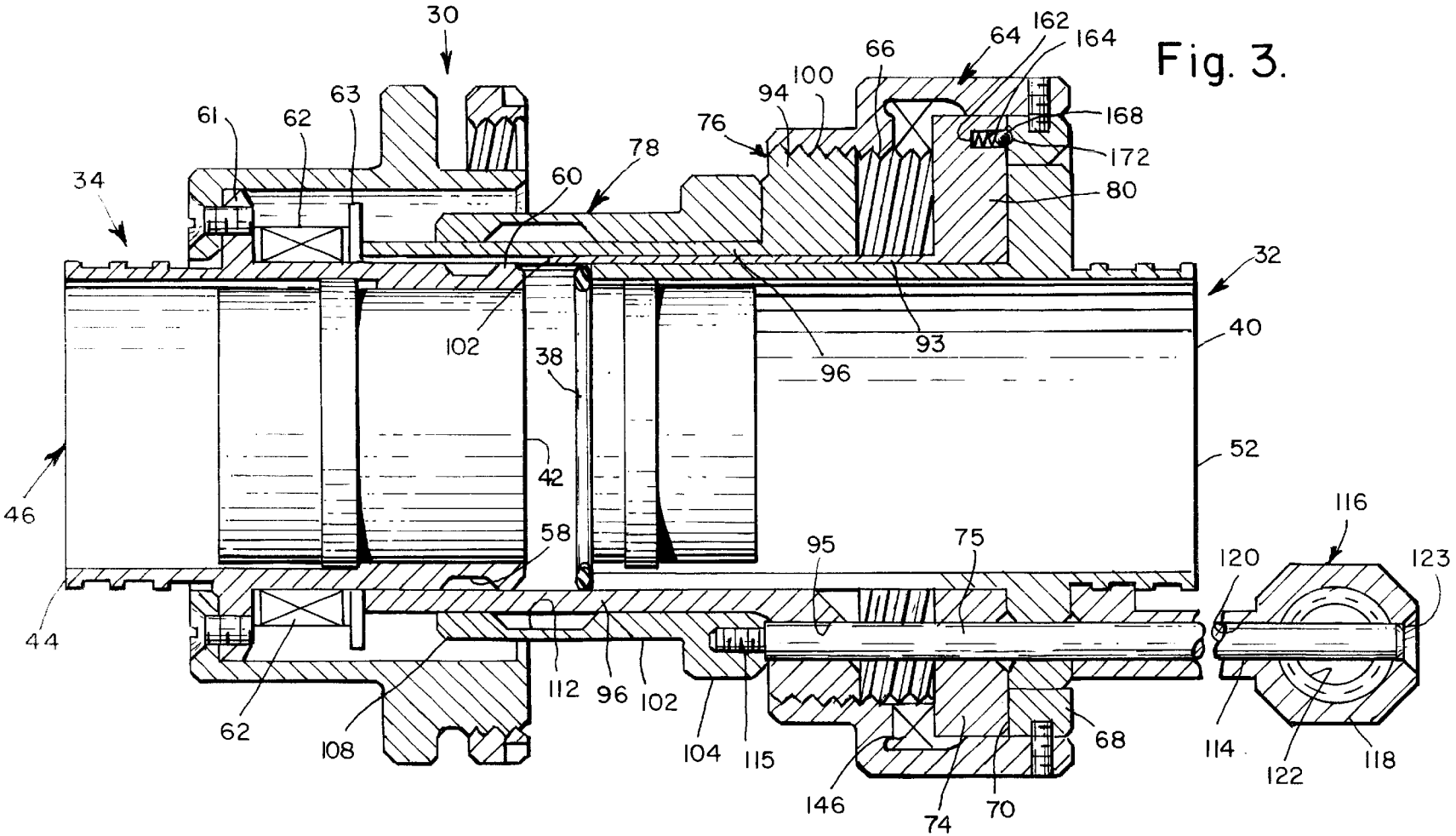
Figure 10:
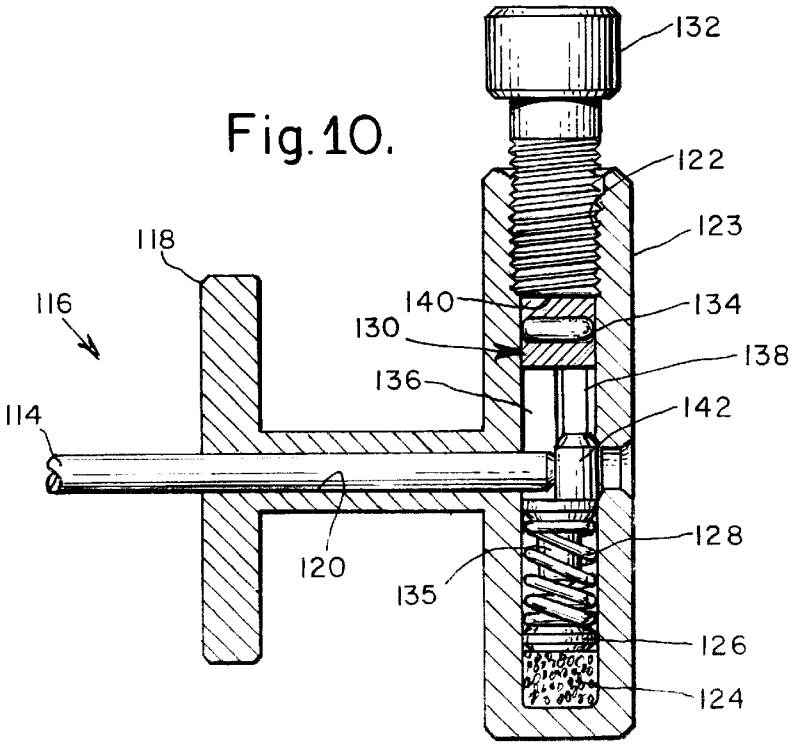
FIG. 10 is a cross-sectional view of the manifold illustrated in FIG. 1, taken 90° from that shown therein.
Figure 12:
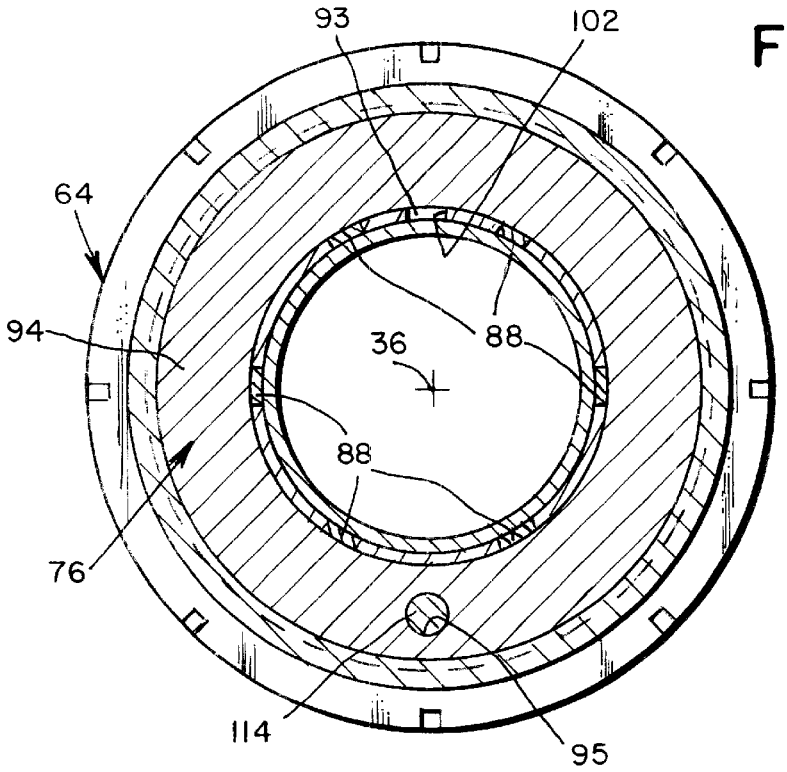
FIG. 12 is a cross-sectional view of the plug assembly taken along line 12—12 of FIG. 1.
Figure 11:
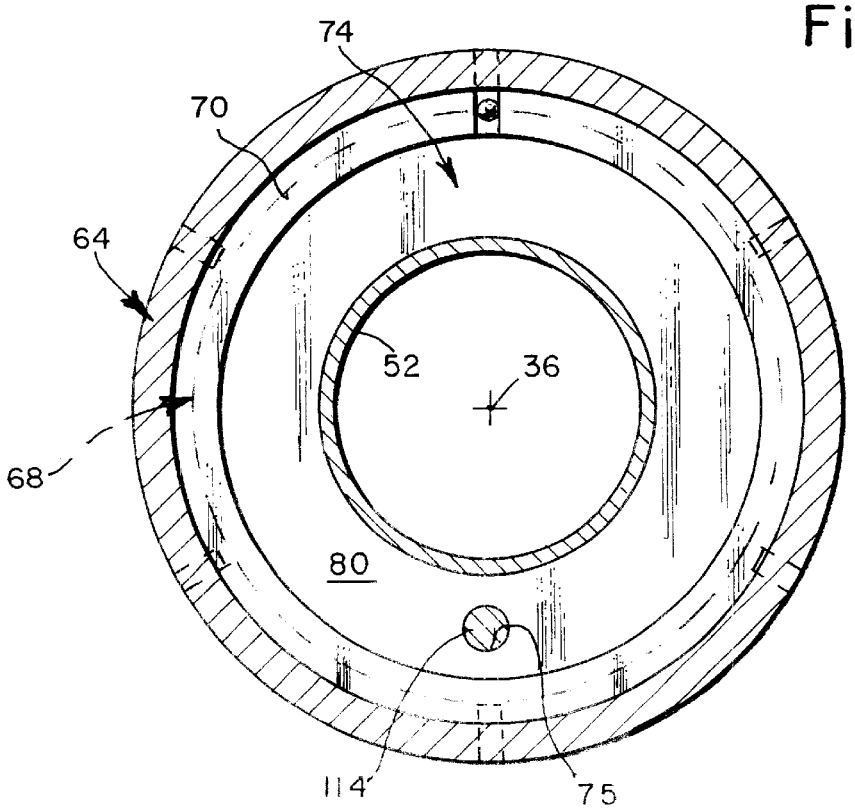
FIG. 11 is a cross-sectional view of the plug assembly taken along line 11—11 of FIG. 1.
Figure 14:
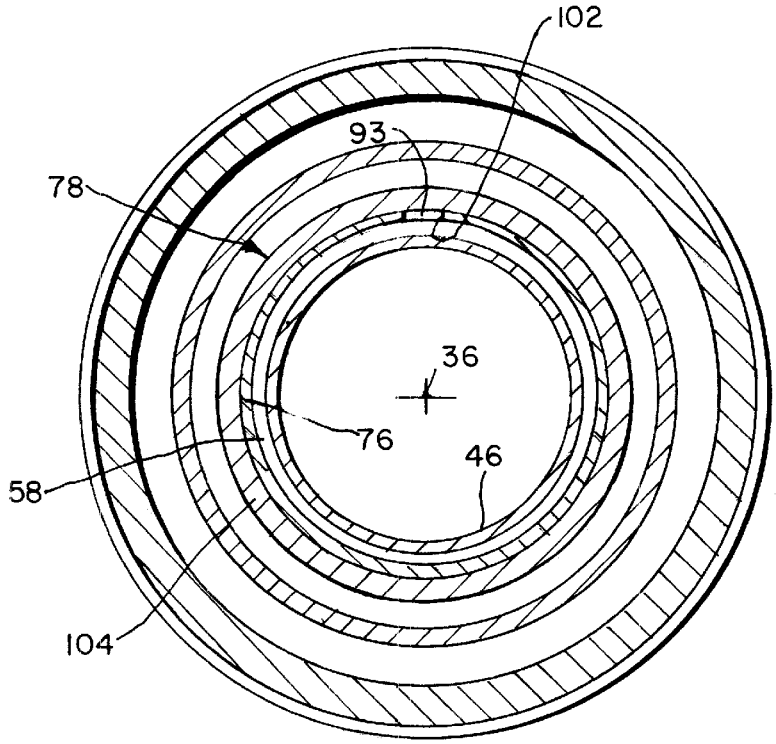
FIG. 14 is a cross-sectional view of the plug assembly taken along line 14—14 of FIG. 1.
Figure 13:
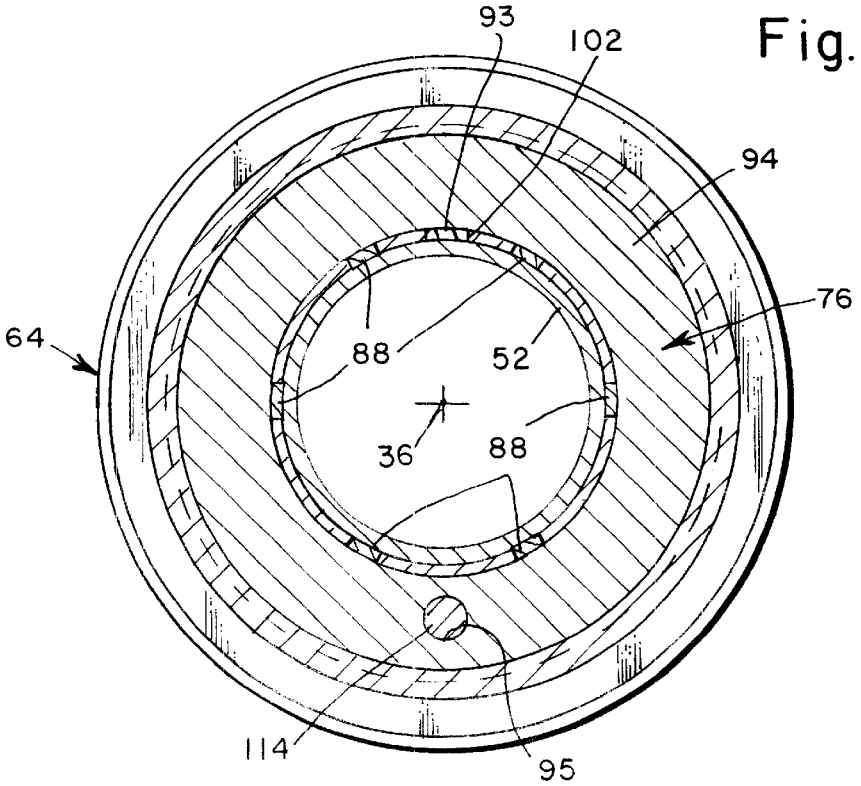
FIG. 13 is a cross-sectional view of the plug assembly taken along line 13—13 of FIG. 1.
Figure 16:
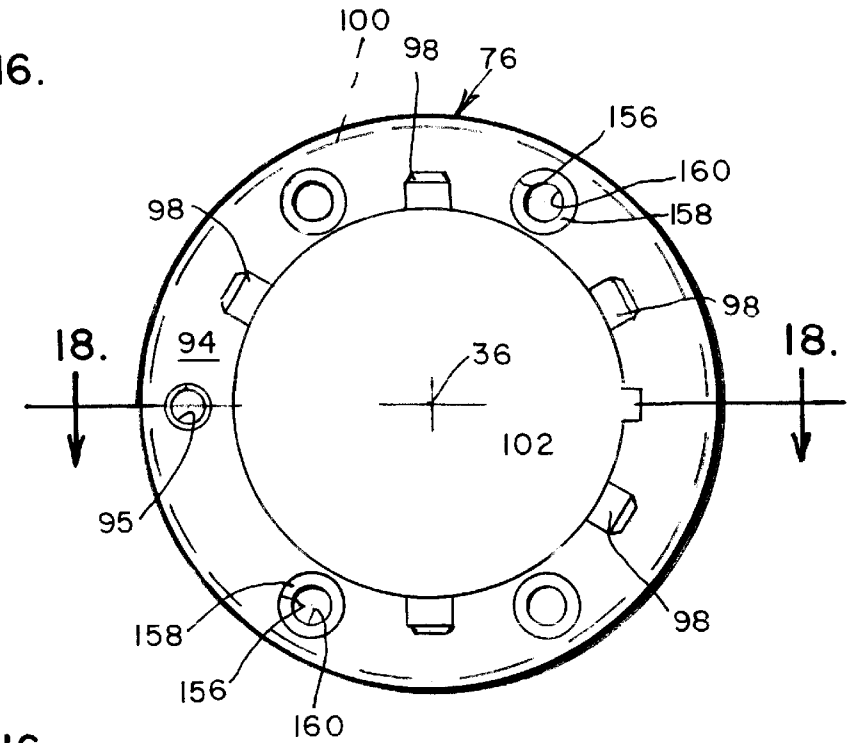
Figure 15:
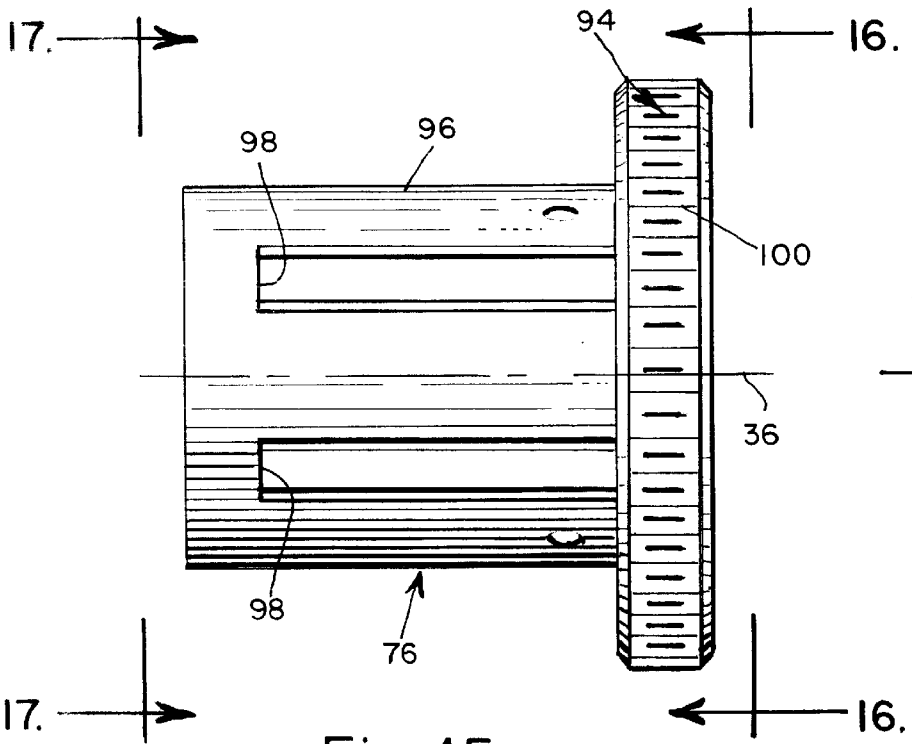
Figure 17:
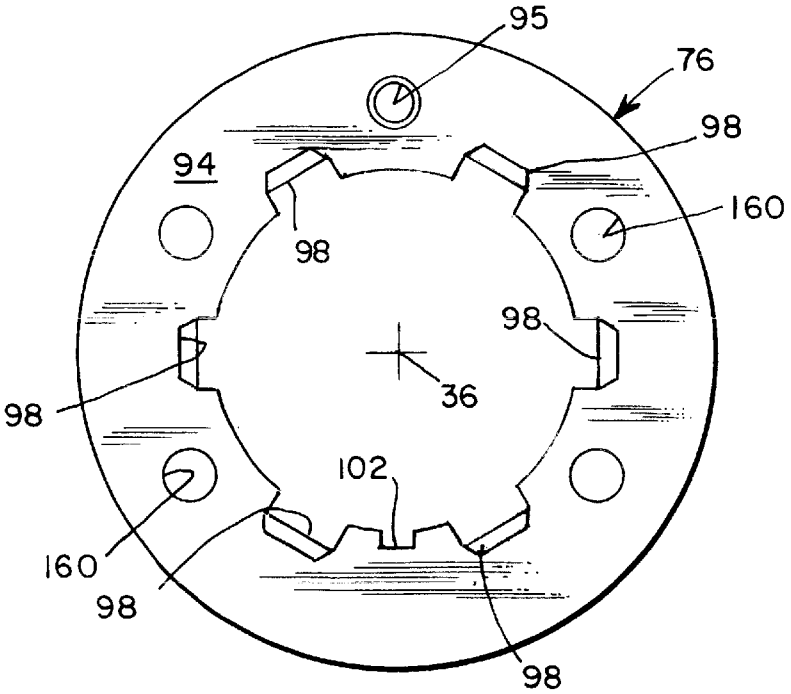
Figure 18:
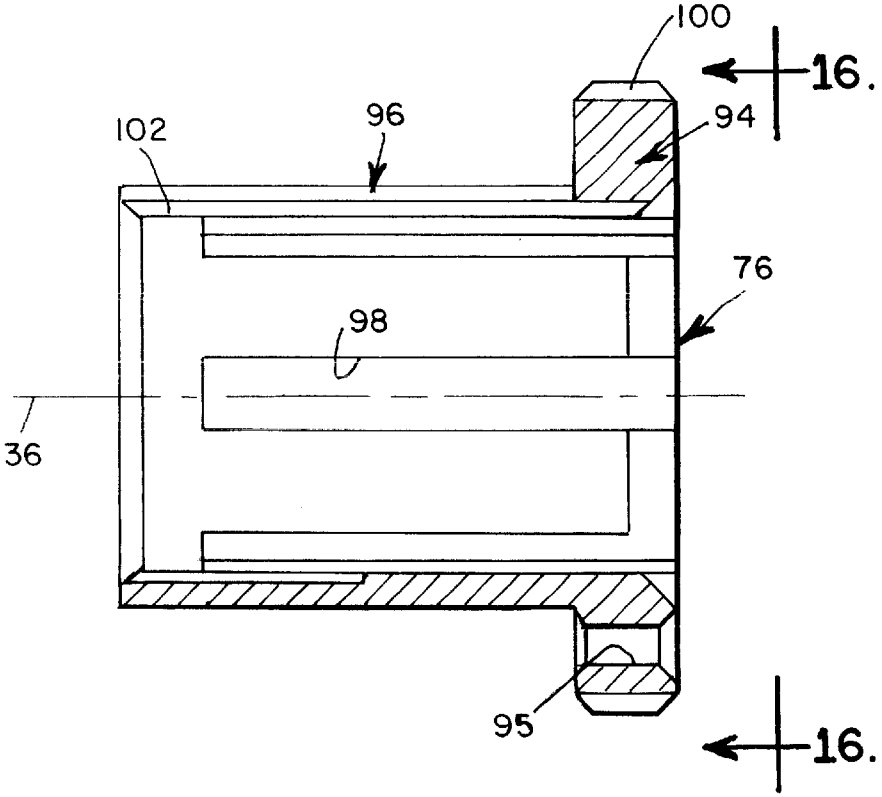

Manifold assembly 116 (see FIGS. 1–3 and 10) positioned adjacent said plug assembly rear end 40, and includes a manifold housing 118 having a cylindrical opening 120 for receipt of restraining shaft 114, and a second cylindrical opening 122 positioned normally with respect to cylindrical opening 120. Opening 120 extends fully through an exterior wall 123 of the manifold housing. Placed within cylindrical opening 122, in seriatim, are a buffer sponge 124 (e.g., of silicone rubber), a bracing disc 126, a compression spring 128, a piston 130 and a retaining screw 132. Piston 130 is sealed within the interior walls of cylindrical opening 122 by an O-ring 134 at one end of the piston. The other end of the piston forms a reduced diameter portion 135 which forms a shank for receipt and support of one end of compression spring 128. The other end of the compression spring bears against disc 126. The piston includes an oval opening 136 which opens at a first side facing restraining shaft 114 and a circular opening 138 facing manifold housing wall 123. The radius of circular opening 138 is the same as the radii at the ends of oval opening 136, so that the surfaces of openings 136 and 138 adjacent O-ring 130 form a common wall 140. That portion of oval opening 136 which is not common with circular opening 138 forms a barrier 142 which, as shown in FIGS. 1, 2 and 10, constitutes a block to the passage of restraining shaft 114 to manifold housing wall 123. Upon relocation of the piston, so as align circular hole 138 with cylindrical opening 120, as depicted in FIG. 3, the piston can move to the extremity of opening 120 at wall 123, as will be explained below with respect to spring or other biasing instrumentalities. Relocation of the piston can be effected by replacing retaining screw with, for example, a squib which exerts an explosive force on the piston.

Such spring or other biasing instrumentalities comprise withdrawal spring elements comprising a plurality of springs 144, a loading spring 146 and ejection spring 62.

Withdrawal springs 144 (see FIGS. 4–7 and 22), typically four in number, are supported on individual withdrawal pins 148, which are threaded to locking sleeve 78 by screw ends 150. Each pin 148 terminates in a head 152, which is connected to each screw end by a shank 154 and against which one end of each spring 144 presses. The other end of each spring is received within a cylindrical opening 156 of shell 76 and bears against an end wall 158 thereof. End wall 158 is provided with an opening 160 so that pin shank 154 may pass therethrough to enable the withdrawal pins to be threadedly secured to locking sleeve 76. This coupling arrangement with the locking sleeve and the shell biases the locking sleeve and the shell towards one another. The withdrawal springs have conditions of being relatively uncompressed and fully compressed.

Loading spring 146 is positioned between coupling ring 64 and collet hub 80 and biases the coupling ring towards plug assembly front end 32 and collet 74 towards plug assembly rear end 40. The biasing spring also has conditions of being relatively uncompressed and fully compressed.

Movement of shell 76 with respect to coupling ring 64 through the threaded engagement therebetween is precisely controlled by delimiting the rotational relationship between collet 74 and the coupling ring. Specifically, a biased detent is precisely located in the collet by forming a recess 162 therein, in which a spring 164 and a ball 168 are placed. The ball is therefore biased by the spring towards surface 70 of timing ring 68 which is affixed to coupling ring 64. The position of notch 72 in surface 70 of timing ring 68 vis-a-vis the biased detent formed by ball 168 and spring 164 in the collet determines the rotational limit of the coupling ring and, therefore, the extent that it moves the shell. This arrangement compensates for the need to establish a polar timing of the threaded engagement between the coupling ring and the shell, that is, the positioning of plug assembly housing 52 with reference to the collet, when the ball is in the notch.

Coupling ring 64 is threaded as a jack screw, that is, with acme threads. Because an operator must often reach through a hole to insert plug assembly 32 into receptacle assembly 34, or vice-versa, to couple the two assemblies together, typically the operator cannot remove his hand from holding the relevant assembly until the mating is complete. In the present invention, however, the mating can occur through use of an operator's single hand.

Operation of umbilical disconnect connector 30 is described in the following order when it is in its ready-to-mate, its mated and its triggered states.

In the ready-to-mate state, axially inwardly facing protuberances 90 abut receptacle assembly terminal abutment 60 and are positioned adjacent to receptacle assembly annular groove 58. Axially outwardly extending protuberances 92 are aligned with locking sleeve annular groove 112 to permit cantilevered movement of inwardly extending protuberances 90 over abutment 60 and into receptacle assembly annular groove 58. Ball detent 168 is engaged with timing ring notch 72, shell support 94 is in contact with collet hub 80, interfacing springs 144 are in their fully compressed condition, restraining shaft 114 is in its locking sleeve unlocking position, loading spring 164 between coupling ring 64 and collet hub 80 is in its relatively uncompressed condition, and ejection spring 62 in receptacle assembly 34 is in its relatively uncompressed condition.

In the mated state, after coupling ring 64 has been rotated with respect to shell 76, axially inwardly facing protuberances 90 are engaged with receptacle assembly annular groove 58, axially outwardly facing protuberances 92 are positioned against locking sleeve surface 110 adjacent to locking sleeve annular groove 58 to prevent escape of inwardly facing protuberances 90 from receptacle assembly annular groove 58, detent ball 168 is radially spaced from timing ring notch 72, shell support 94 is spaced from contact with collet hub 80, interfacing springs 144 remain in their fully compressed condition, restraining shaft 114 is positioned in its locking sleeve locking position, and ejection spring 62 is compressed by locking sleeve 78 upon contact with its end 108.

In the triggered state, after coupling ring 64 has been rotated back with respect to shell 76, axially inwardly facing protuberances 90 are disengaged from receptacle assembly annular groove 58 upon movement of piston 130 in which its circular opening 138 in aligned with restraining shaft opening 120 (restraining shaft 114 is positioned in its locking sleeve unlocking position), axially outwardly facing protuberances 92 are again aligned with locking sleeve annular groove 112 upon escape of inwardly facing protuberances 90 from receptacle assembly annular groove 58, detent ball 168 is again engaged timing ring notch 72, shell support 94 remains spaced from contact with collet hub 80, and withdrawal springs 144 are in their relatively uncompressed condition.

Although the invention has been described with respect to a particular embodiment thereof, it should be realized that various changes and modifications may be made therein without departing from the spirit and scope of the invention.

What is claimed is:

1. An umbilical disconnect connector comprising a plug assembly and a receptacle assembly:

said plug and said receptacle assemblies being deployable in ready-to-mate, mated and triggered states, and having a common center axis and front and rear ends, in which said respective front ends are disposed to face one another;

said receptacle assembly including a housing for receiving and supporting electromagnetic energy carrier means having termination means adjacent said housing front end, said housing ending in an annular groove facing outwardly from the axis and positioned adjacent to said termination means and a terminal abutment adjacent to said annular groove, and an ejection spring centered about the axis and positioned between said annular groove and said receptacle assembly rear end, said ejection spring having conditions of being relatively uncompressed and fully compressed;

said plug assembly including a housing for receiving and supporting electromagnetic energy carrier means having, adjacent sad plug assembly housing front end, termination means disposed to establish a connection with said termination means in said receptacle assembly, a coupling ring having internal threads facing the axis and a timing ring having a surface extending normal to the axis and a notch in said surface, a collet, a shell and a locking sleeve positioned about the axis on and supported by said plug assembly housing, and a manifold assembly positioned adjacent said plug assembly rear end, and including a restraining shaft secured to said locking sleeve and positionable for enabling said locking sleeve to be placed in locking and unlocking positions, and a mechanism for enabling said restraining shaft to be placed in its locking and unlocking positions, and instrumentation coupled to said restraining shaft for positioning said shaft in its locking position and enabling said shaft to be placed in its unlocking position, said shell having an externally threaded support threadedly engaged with said coupling ring threads, and including a cylindrical portion and a plurality of slots therein extending from said threaded support and parallelly to the axis and towards said receptacle assembly housing, said collet including a hub concentrically surrounding said plug assembly housing and having a connection therewith for enabling an axial translation and a non-rotatable coupling tharebetween, a biased detent engageable with said timing ring and said timing ring notch thereof, and a plurality of cantilevered fingers extending from said hub and substantially parallelly to the axis towards said receptacle assembly housing, and individually terminating in a pair of protuberances extending respectively towards and away from the axis, said cantilevered fingers being capable of biasable movement towards and away from the axis and being positioned within said plurality of slots, and said locking sleeve having a cylindrical portion extending parallelly to the axis towards said receptacle assembly housing, an end terminating said cylindrical portion, a surface generally In contact with said collet fingers and said shell cylindrical portion, and an annular groove facing towards the axis, withdrawal interfacing spring elements having a coupling arrangement with said locking sleeve and said shell for biasing said locking sleeve and said shell towards one another, said withdrawal spring elements having conditions of being relatively uncompressed and fully compressed, a loading spring positioned between said coupling ring and said collet hub for biasing said coupling ring towards said plug assembly front end and said collet towards said plug assembly rear end, said biasing loading spring having conditions of being relatively uncompressed and fully compressed, wherein, in the ready-to-mate state, said axially inwardly facing protuberances abut said receptacle assembly terminal abutment and are positioned adjacent to said receptacle assembly annular groove, said axially outwardly extending protuberances are aligned with said locking sleeve annular groove to permit cantilevered movement of said inwardly extending protuberances over said abutment and into said receptacle assembly annular groove, said detent is engaged with said timing ring notch, said shell support is in contact with said collet hub, said interfacing spring elements are in a fully compressed condition, said restraining shaft Is in its locking sleeve unlocking position, said loading spring between said coupling ring and said cal let hub is in its relatively uncompressed condition, and said ejection spring in said receptacle assembly is in its relatively uncompressed condition, wherein, In the mated state, after said coupling ring has been rotated with respect to said shell, said axially inwardly facing protuberances are engaged with said receptacle assembly annular groove, said axially outwardly facing protuberances are positioned against said locking sleeve surface adjacent to said locking sleeve annular groove to prevent escape of said inwardly facing protuberances from said receptacle assembly annular groove, said detent is radially spaced from said timing ring notch, said shell support is spaced from contact with said collet hub, said interfacing spring elements remain in their fully compressed condition, said restraining shaft is positioned in its locking sleeve locking position, and said ejection spring is compressed by said locking sleeve upon contact with its end, wherein, in the triggered state, after said coupling ring has been rotated back with respect to said shell, said axially inwardly facing protuberances are disengaged from said receptacle assembly annular groove, said axially outwardly facing protuberances are again aligned with said locking sleeve annular groove upon escape of said inwardly facing protuberances from said receptacle assembly annular groove, said detent is again engaged said timing ring notch, said shell support remains spaced from contact with said collet hub, said interfacing spring elements are in their relatively uncompressed condition, and said restraining shaft is positioned in its locking sleeve unlocking position.

2. An umbilical disconnect connector according to claim 1 further including:

a longitudinally extending limiting bar secured to said collet and extending towards said receptacle assembly for defining the limit of engagement between said plug and receptacle assemblies; and a slot in said shell for receiving said limiting bar.

3. An umbilical disconnect connector according to claim 1 wherein said timing ring is adjusted with respect to said coupling ring to provide a precise timing relationship between said collet detent and said timing ring notch and, consequently, a precise movement of said shell resulting from the threaded engagement with said coupling ring.

4. A connector incorporating a plug assembly and a receptacle assembly for housing, coupling and decoupling electromagnetic energy carriers supported in said respective assemblies, comprising:

first mating structure carried by one of said assemblies, including at least one locking element;

second mating structure carried by the other of said assemblies, being adapted to lockingly engage said at least one locking element of said first mating structure;

said first mating structure including gripping structure couplable with said at least one locking element and having (a) a first position for enabling said at least one locking element to engage said second mating structure, and (b) a second position for enabling said at least one locking element to be locked to said second mating structure; and enabling structure associated with said gripping structure for effecting said first and second positions thereof;

wherein said plug and receptacle assemblies are positionable on a common axis, said gripping structure comprises a coupling ring, and said first mating structure further includes a housing for receiving and supporting one of the electromagnetic energy carriers in said other of said assemblies, a timing ring having a surface centered on and extending normal to the axis and a notch in said surface, a collet including a hub concentrically surrounding said housing and having a connection therewith for enabling an axial translation and a non-rotatable coupling therebetween, and a detent on said collet engageable with said timing ring and said timing ring notch thereof, and wherein said timing ring is adjustable with respect to said coupling ring to provide a precise timing relationship between said collet detent and said timing ring notch and, consequently, to effect a precise movement of said at least one locking element vis-a-vis its coupling with said coupling ring.

5. A connector incorporating a plug assembly and a receptacle assembly for housing, coupling and decoupling electromagnetic energy carriers supported in said respective assemblies, comprising:

first mating structure carried by one of said assemblies, including at least one locking element;

second mating structure carried by the other of said assemblies, being adapted to lockingly engage said at least one locking element of said first mating structure;

said first mating structure including gripping structure couplable with said at least one locking element and having (a) a first position for enabling said at least one locking element to engage said second mating structure, and (b) a second position for enabling said at least one locking element to be locked to said second mating structure;

enabling structure associated with said gripping structure for effecting said first and second positions thereof; and a restraining mechanism secured to said enabling structure and positionable for enabling said enabling structure to effect said first and second positions, said restraining mechanism including instrumentality for enabling selective automatic and manual implementation thereof.

6. A connector according to claim 5 in which said restraining mechanism comprises:

a restraining shaft secured to said enabling structure and positionable for enabling said enabling structure to be placed in said first and second positions, and a mechanism for enabling said restraining shaft to be placed in its first and second positions, and instrumentation coupled to said restraining shaft for positioning said shaft in its first position and enabling said shaft to be placed in its second position.

7. A connector according to claim 6 in which said restraining shaft enabling mechanism includes a latching device and an explosive squib and a manually actuator therefor.

8. A connector incorporating a plug assembly and a receptacle assembly for housing, coupling and decoupling electromagnetic energy carriers supported in said respective assemblies, comprising:

first mating structure carried by one of said assemblies, including at least one locking element;

second mating structure carried by the other of said assemblies, being adapted to lockingly engage said at least one locking element of said first mating structure;

said first mating structure including a coupling ring having a connection with said at least one locking element and having (a) a first position for enabling said at least one locking element to engage said second mating structure, and to pull said second mating structure towards said first mating structure and thereby for coupling said electromagnetic energy carriers into contact with one another and (b) a second position for enabling said at least one locking element to be locked to said second mating structure; and enabling structure associated with said coupling ring for effecting said first and second positions thereof.

9. A connector incorporating a plug assembly and a receptacle assembly positionable on a common axis for housing, coupling and decoupling electromagnetic energy carriers supported in said respective assemblies, comprising:

first mating structure carried by one of said assemblies, including at least one locking element;

second mating structure carried by the other of said assemblies, being adapted to lockingly engage said at least one locking element of said first mating structure;

said first mating structure including a housing for receiving and supporting one of the electromagnetic energy carrier means, a coupling ring having internal threads facing the axis and a timing ring having a surface extending normal to the axis and a notch in said surface, a collet, a shell and a locking sleeve positioned about the axis on and supported by said housing, said shell having an externally threaded support threadedly engaged with said coupling ring threads, and including a cylindrical portion and a plurality of slots therein extending from said threaded support and parallelly to the axis and towards said receptacle assembly housing, said collet including a hub concentrically surrounding said housing and having a connection therewith for enabling an axial translation and a non-rotatable coupling therebetween, a biased detent engageable with said timing ring and said timing ring notch thereof, and a plurality of cantilevered lingers extending from said hub and substantially parallelly to the axis towards said receptacle assembly housing, and individually terminating in a pair of protuberances extending respectively towards and away from the axis, said cantilevered fingers being capable of biasable movement towards and away from the axis and being positioned within said plurality of slots, and said locking sleeve having a cylindrical portion extending parallelly to the axis towards said one assembly, an end terminating said cylindrical portion, a surface generally in contact with said collet fingers and said shell cylindrical portion, and an annular groove facing towards the axis, withdrawal interfacing spring elements having a coupling arrangement with said locking sleeve and said shell for biasing said locking sleeve and said shell towards one another, said withdrawal spring elements having conditions of being relatively uncompressed and fully compressed, and a loading spring positioned between said coupling ring and said collet hub for biasing said coupling ring towards said plug assembly front end and said collet towards said plug assembly rear end, said biasing loading spring having conditions of being relatively uncompressed and fully compressed.

10. A connector according to claim 9, further including a manifold assembly positioned adjacent said plug assembly rear end, and including a restraining shaft secured to said locking sleeve and positionable for enabling said locking sleeve to be placed in locking and unlocking positions, a mechanism for enabling said restraining shaft to be placed in its locking and unlocking positions, and instrumentation coupled to said restraining shaft for positioning said shaft in its locking position and enabling said shaft to be placed in its unlocking position.

* * * * *